US006587662B2

(12) United States Patent
Kobaru et al.

(10) Patent No.: US 6,587,662 B2
(45) Date of Patent: Jul. 1, 2003

(54) IMAGE FIXING APPARATUS HAVING SEPARATING CLAW

(75) Inventors: Yasunari Kobaru, Shizuoka (JP); Takayasu Yuminamochi, Shizuoka (JP); Takashi Narahara, Shizuoka (JP); Tomoyuki Makihira, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/922,838

(22) Filed: Aug. 7, 2001

(65) Prior Publication Data

US 2002/0044803 A1 Apr. 18, 2002

(30) Foreign Application Priority Data

Aug. 9, 2000 (JP) ..... 2000-240552

(51) Int. Cl.[7] ..... G03G 15/20
(52) U.S. Cl. ..... 399/323
(58) Field of Search ..... 399/322–324

(56) References Cited

U.S. PATENT DOCUMENTS

| | | | | | |
|---|---|---|---|---|---|
| 5,517,292 A | * | 5/1996 | Yajima et al. | ..... | 399/323 |
| 5,682,576 A | | 10/1997 | Sakai et al. | ..... | 399/69 |
| 6,005,594 A | | 12/1999 | Nanataki et al. | ..... | 347/156 |
| 6,029,038 A | * | 2/2000 | Uehara et al. | ..... | 399/323 |

* cited by examiner

*Primary Examiner*—William J. Royer
(74) *Attorney, Agent, or Firm*—Fitzpatrick, Cella, Harper & Scinto

(57) ABSTRACT

In an oilless fixing apparatus of an image heating apparatus, a surface of a fixing roller or a pressure roller tends to be abraded by a separating claw if the contact pressure thereof is high, whereby the service life of the fixing roller or the pressure roller is often shortened. If the radius of curvature of the tip of the separating claw is reduced, there may be applied an excessively large force on the tip of the separating claw and the fixing roller or the pressure roller may be fatally damaged.

1 Claim, 8 Drawing Sheets

IMAGE FIXING APPARATUS HAVING SEPARATING CLAW

BACKGROUND OF THE INVENTION

1. Field of the Invention

The present invention relates to an image heating apparatus, represented by a fixing apparatus provided in an electrophotographic image forming apparatus such as a printer or a copying apparatus.

2. Related Background Art

As the fixing apparatus provided in the electrophotographic image forming apparatus such as a printer or a copying apparatus, there is conventionally known a fixing apparatus in which a transfer material constituting a recording material and bearing an unfixed toner image is heated and pressed by conveying through a nip portion formed by a fixing roller constituting a fixing member provided therein with a heat source and a pressure roller constituting a pressing member and maintained in pressure contact with the fixing roller, whereby the unfixed image is fixed to the transfer material.

In an image forming apparatus of a relatively high speed, the above-mentioned fixing roller is usually composed of a metal core and an elastic rubber layer formed thereon. This is because the surface of the fixing roller is preferably flexible in order to improve contact with the unfixed toner image on the transfer material and to efficiently melt such unfixed toner image, as the transfer material employed in the image forming apparatus is often formed as a sheet with surface irregularities such as paper. Also the surface of the fixing roller is coated with fluorinated resin in order to facilitate releasing of the toner. Further, a web impregnated with a releasing agent such as silicone oil is maintained in contact with the fixing roller to form a thin oil layer thereon, thereby improving the property against toner offsetting.

The pressure roller is often provided with an elastic rubber layer thicker in comparison with that of the fixing roller, in order to form a predetermined nip in contact with the fixing roller. The surface of the pressure roller is also often coated with a fluorinated resin in order to facilitate releasing of the toner.

Also in order to resolve the offsetting drawback in such fixing apparatus, there is recently known an oilless fixing apparatus in which a potential difference is induced between the surface of the fixing roller and the pressure roller in such a direction as to press the unfixed toner image toward the paper thereby preventing the toner offsetting onto the fixing roller and dispensing with the oil coating member such as the above-mentioned web.

Such configuration allows compactization of the fixing apparatus, prevents defects such as oil leakage or oil blotting to the transfer material and reduces the toils of the user required for periodical replacement of a cleaning member.

On the other hand, in order to prevent wrapping of the transfer material around the fixing roller or the pressure roller, a separating claw is provided in contact with the surface thereof. In order to separate the transfer material of a thickness of about 100 $\mu$m form the surface of the fixing roller or the pressure roller, the tip of the separating claw is formed as a small curved face of a radius R of curvature within a range of 0.07–0.1 mm in a cross section perpendicular to the axis of the fixing roller or the pressure roller. Such separating claw is maintained in contact with the fixing roller or the pressure roller under a predetermined pressure, in order to achieve satisfactory separation for the ordinary transfer material such as paper.

In the conventional fixing apparatus provided with the above-mentioned oil coating member, in order to separate the transfer material of a thickness of about 100 $\mu$m from the surface of the fixing roller or the pressure roller, it is necessary to maintain a separating claw with a radius R of curvature of 0.07–0.1 mm in contact with the surface of the fixing roller or the pressure roller with a linear pressure of 0.196 N/mm or higher. However, in the above-mentioned oilless fixing apparatus, lacking the oil serving as lubricant between the separating claw and the surface of the fixing roller or the pressure roller, such surface tends to be abraded by the separating claw if the contact pressure thereof is high, whereby the service life of the fixing roller or the pressure roller is often shortened.

In order to avoid such drawback, there is empirically known a method of forming the tip of the separating claw into an extremely sharp form with a radius R of curvature not exceeding 10 $\mu$m and reducing the contact pressure of the separating claw to the fixing roller or the pressure roller. However, if the radius R of curvature of the tip of the separating claw is simply reduced, such separating claw naturally pierces easily the fixing roller or the pressure roller provided with an elastic layer, and, in case of fixation of a recording material which is difficult to separate from the fixing roller or the pressure roller by the intrusion of the tip of the separating claw, such as a recording material bearing the image to the end thereof or an overhead projector transparency (OHT) sheet for color, surfacially coated with a resin layer, there may be applied an excessively large force on the tip of the separating claw and the fixing roller or the pressure roller may be fatally damaged. Also since the separating claw is rotatably supported, the tip of the separating claw may be inclined by the amount of play in the rotatable supporting shaft in case of defective separating operation, thereby resulting in so-called uneven contact phenomenon where one of the corner portions of the tip of the separating claw, in the axial direction of the fixing roller or the pressure roller, comes into contact with the surface thereof, thereby damaging such surface.

In the fixing apparatus (particularly oilless fixing apparatus) which separates the transfer material by contacting the separating claw with the fixing roller or the pressure roller provided with the elastic layer, there has not been found a condition capable of preventing fatal damage to the fixing roller or the pressure roller while attaining satisfactory service life of the fixing roller or the pressure roller under contact by the separating claw.

SUMMARY OF THE INVENTION

In consideration of the foregoing, an object of the present invention is to provide an image heating apparatus providing a satisfactorily long service life.

Another object of the present invention is to provide an image heating apparatus capable of providing satisfactory separating performance for the recording material, while preventing the damage on a rotating member.

Still another object of the present invention is to provide an image heating apparatus comprising:

- a rotating member rotating in contact with a recording material; and
- a separating claw for separating the recording material from the rotating member;

wherein the micro hardness A [°] of the surface of the rotating member and the radius R {mm} of curvature of the tip of the separating claw satisfy the following relationships:

$$A \geqq -3250.0R^2+90.5R+82.5 \text{ and } 0.02 \leqq R \leqq 0.05.$$

Still other objects of the present invention will become fully apparent from the following detailed description to be taken in conjunction with the accompanying drawings.

DETAILED DESCRIPTION OF THE PREFERRED EMBODIMENTS

Now the present invention will be clarified in detail by preferred embodiments thereof, with reference to the accompanying drawings.

First Embodiment

At first there will be explained a first embodiment of the present invention.

Figure 1:
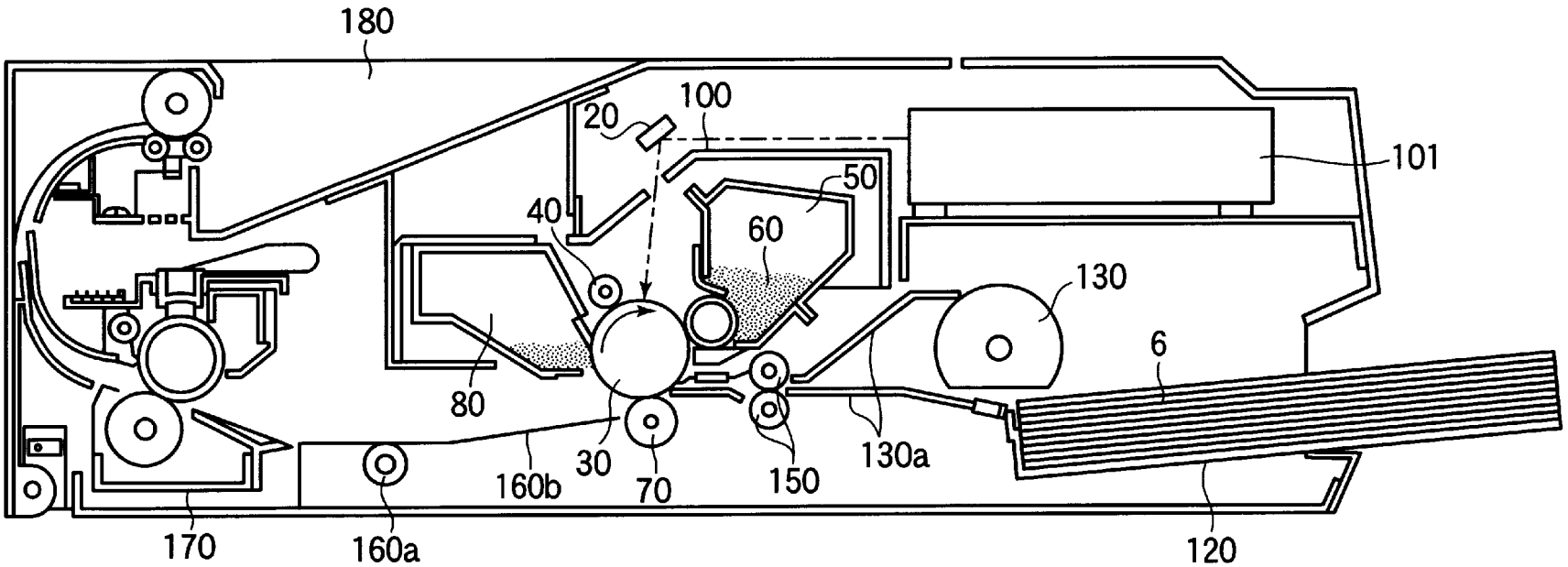
FIG. 1 is a cross-sectional view schematically showing the configuration of an image forming apparatus in a first embodiment of the present invention.

FIG. 1 is a cross-sectional view schematically showing the configuration of a laser beam printer (hereinafter simple called printer) constituting an example of the image forming apparatus.

The printer of the present embodiment is a laser beam printer of a relatively high process speed of 200 mm/s utilizing reversal development with negative toner.

Such printer is provided with a scanner unit 101 for emitting a laser beam according to image information for scanning, and a process cartridge 100 incorporating principal image forming means.

The process cartridge 100 is provided, as image forming means, with a photosensitive drum 30 constituting a latent image bearing member bearing a latent image, a roller charger 40 consisting of semiconductive rubber, a developing apparatus 50 for providing toner 60 onto the photosensitive drum 30 thereby developing the latent image, and a cleaner 80 for removing used toner from the photosensitive drum 30.

In the process cartridge 100, the photosensitive drum 30, being rotated in a direction indicated by an arrow, is surfacially charged uniformly and is irradiated with the laser light emitted from the scanner unit 101 and coming through a mirror 20 thereby forming an electrostatic latent image on the surface.

The electrostatic latent image is rendered visible as a toner image by toners deposition in the developing apparatus 50.

On the other hand, a sheet 6 in a sheet cassette 120 is separated and fed one by one by means of a sheet feeding roller 130 and a separating pad (not shown) opposed thereto, and the fed sheet 6 is conveyed along upper and lower guides 130*a* to paired registration rollers 150. The registration rollers 150 are stopped until the arrival of the sheet 6, which impinges on such rollers whereby the skewed feed of the sheet can be corrected. Then the registration rollers 150 convey the sheet 6 to a transfer portion in synchronization with the leading end of the image formed on the photosensitive drum 30. In the present embodiment a sheet feed sensor (not shown) is provided in the vicinity of the registration rollers 150 to detect sheet passing state, sheet jamming and sheet length.

The sheet 6 conveyed to the transfer portion as explained in the foregoing is given a charge of a polarity opposite to that of the toner by a transfer roller 70 positioned at the rear side of the sheet, whereby the toner image formed on the photosensitive drum 30 is transferred onto the sheet 6. The sheet 6 bearing the transferred toner image is conveyed by a conveying roller 160*a* and a conveying guide 160*b* to a fixing apparatus 170, which forms a recorded image by melt and fixing the toner image on the sheet 6 by heat and pressure. The sheet 6 bearing the fixed image is discharged onto a discharge tray 180 through conveying rollers selected by a flapper (not shown).

Figure 2:
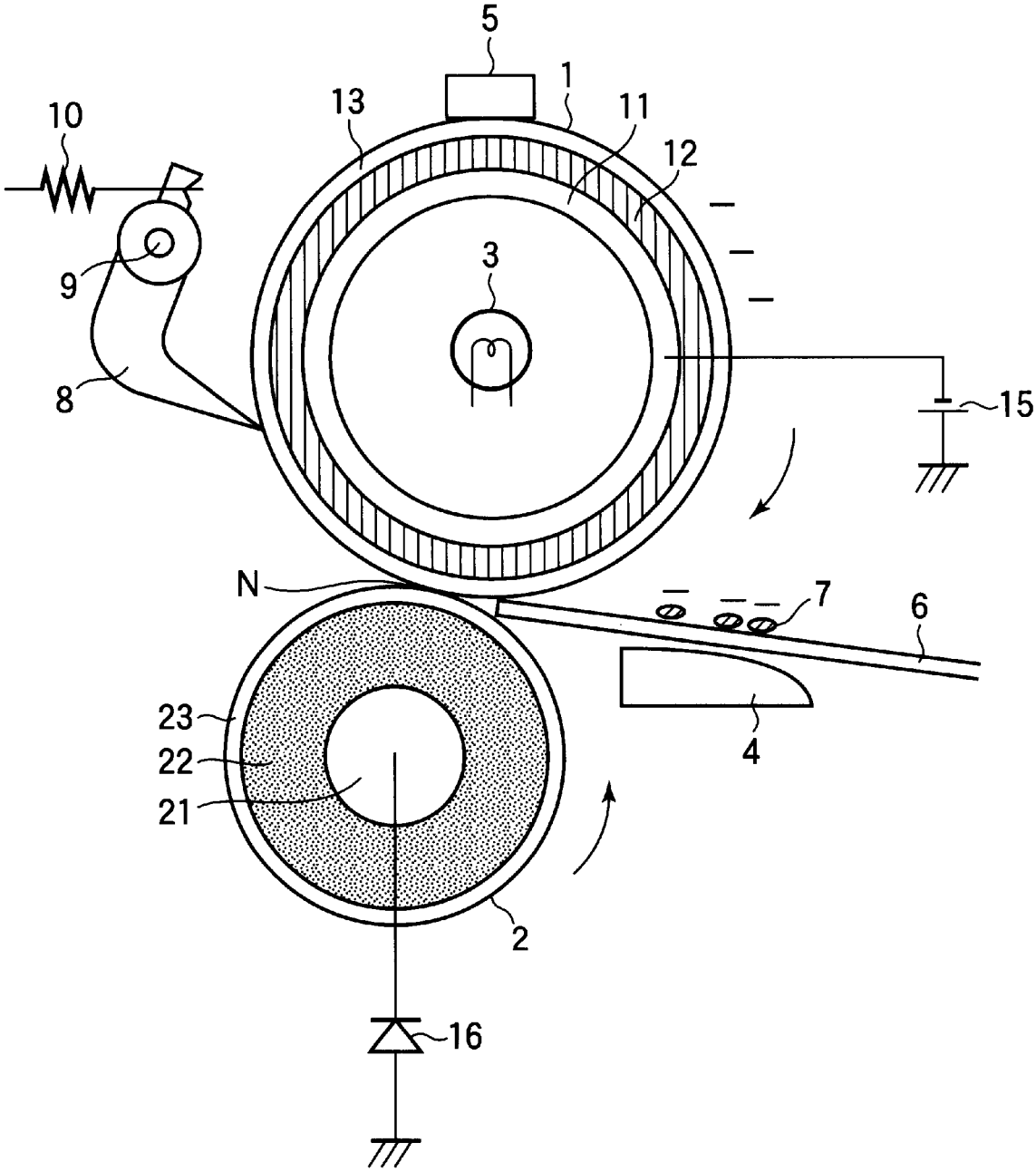
FIG. 2 is a cross-sectional view schematically showing the configuration of a fixing apparatus provided in the image forming apparatus shown in FIG. 1.

Now reference is made to FIG. 2 for explaining the fixing apparatus 170 in detail.

FIG. 2 is a cross-sectional view schematically showing the configuration of the fixing apparatus 170 of the present embodiment.

As shown in FIG. 2, the fixing apparatus 170 is provided with a fixing roller 1, a pressure roller 2 and a halogen heater 3.

The fixing roller 1, having an external diameter of 50 mm, is formed by coating an aluminum metal core 11 of a thickness of 3 mm with an elastic silicone rubber layer 12 of a thickness of 250 $\mu$m and providing thereon a fluorinated resin layer 13 composed of a PFA tube of a thickness of 30 $\mu$m. Inside the fixing roller 1, there is provided the halogen heater 3 for heating the fixing roller 1 from the interior thereof.

The pressure 2, having an external diameter of 40 mm, is pressed to the fixing roller 1 under a pressure of 600N by pressurizing means (not shown) to form a fixing nip of a width of 7 mm. The pressure roller 2 is formed by coating an iron metal core 21 of a diameter of 30 mm with a conductive elastic silicone rubber layer 22 of a thickness of 5 mm and providing thereon a fluorinated resin layer 23 composed of a PFA tube of a thickness of 50 $\mu$m to obtain a hardness of 66° (measured with a Asker-C hardness meter under a load of 9.8N).

In the present embodiment, the fixing roller 1 is composed of a soft roller including an elastic layer to provide satisfactory fixing ability even for an image forming apparatus of a relatively high speed.

The fixing apparatus 170 of the present embodiment is not provided with an oil coating member for coating the fixing roller or the pressure roller with a releasing agent such as oil. Instead, in order to prevent toner offsetting, the metal core of the fixing roller 1 is given a bias voltage of −600 V of a same polarity as that of the toner, by a DC voltage source 15 while the metal core of the pressure roller 2 is grounded through a diode 16, whereby a potential difference of −600 V is formed between the surface of the fixing roller 1 and that of the pressure roller 2.

Also in this fixing apparatus 170, the surface temperature of the fixing roller 1 is detected by a thermistor 5 maintained in contact with the surface of the fixing roller 1 under a predetermined contact pressure, and, based on the detected temperature, an electrical circuit (not shown) executes on-off control of the power supply to the halogen heater 3 so as to maintain a constant surface temperature of the fixing roller 1 during the printing operation.

Therefore, in the fixing apparatus 170, the sheet 6 bearing an unfixed toner image 7 is guided to the fixing nip N in stable manner by an entrance guide 4.

The sheet 6 bearing the unfixed toner image 7 is heated and pressed in the fixing nip N whereby the unfixed toner image 7 is fixed to the sheet 6.

Figure 3:
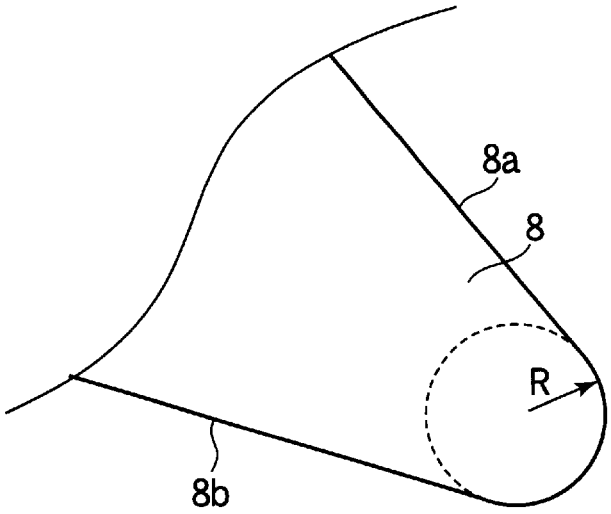
FIG. 3 is a magnified cross-sectional view of a tip portion, constituting a contact portion, of a separating claw provided in the fixing apparatus shown in FIG. 2.

In the present embodiment, in order to prevent wrapping of the recording sheet around the fixing roller after passing the fixing nip N, a separating claw 8 with a pointed tip is maintained in contact with the fixing roller 1. The separating claw 8 is formed by injection molding of a resinous material such as polyimide (PI), polyamide (PA), polyetherketone (PEK) or polyetheretherketone (PEEK) mixed with reinforcing short fibers such as various whiskers, and is provided with a PFA coating of a thickness of several tens of micrometers on the surface in order to avoid toner sticking. The tip, constituting the contact portion, of the separating claw 8 is formed as a small curved surface in a magnified view as shown in FIG. 3. The sharpness of the separating claw 8 will hereinafter be represented by the radius R (of curvature) of an imaginary circle which is so drawn, as shown in FIG. 3, as to be smoothly connected to two ridges 8*a*, 8*b* at the tip of the separating claw 8.

The separating claw 8 is rotatably supported by a rotary shaft 9 on the main body of the fixing apparatus 170, and the upper end of the separating claw 8 is pulled by a tension spring 10 fixed to the main body of the fixing apparatus 170 whereby the tip of the separating claw 8 is maintained in contact under a predetermined pressure with the surface of the fixing roller.

In the present embodiment, the separating claw 8 in contact with the fixing roller 1 (soft roller a) is principally composed of polyimide PI, and has a contact width of 2 mm with the fixing roller 1. The separating claw 8 is provided in 8 units along the longitudinal direction of the fixing roller 1.

In the fixing apparatus 170 of the present embodiment, in order to relax the abrasion of the fixing roller 1 resulting from the contact of the separating claw 8, the tension spring 10, the separating claw 8 and the supporting portion therefor (not shown) are formed as a unit and provided with a reciprocating mechanism for causing a reciprocating motion in the longitudinal direction of the fixing roller 1 by drive means (not shown). The amount of reciprocating motion of such mechanism in the longitudinal direction is selected as 5 mm.

There were prepared separating claws with 7 different radii of curvature at the tip, 6 units for each radius, and the separating claws of each radius were mounted on the fixing apparatus to investigate the damage on the surface of the fixing roller under the pressure in passing the overhead projector transparency (OHT) sheet and the service of the fixing roller (number of passed sheets when the silicone rubber layer is exposed by the abrasion of the PFA tube layer) under the pressure in passing the ordinary paper (Experiment 1). The results are shown in Table 1.

As explained in the foregoing, the fixing roller is a soft roller formed by covering the aluminum metal core of a thickness of 3 mm with a silicone rubber layer of a thickness of 250 $\mu$m and a PFA releasing layer of a thickness of 30 $\mu$m and having a surface hardness of 97° (Asker-C). Also the contact pressure is changed according to the radius of curvature at the tip of the separating claw. This is because the separation of the ordinary paper can be achieved even with a low contact pressure if the radius of curvature is smaller (namely even if the amount of intrusion of the tip of the separating claw into the fixing roller is small), but cannot be achieved if the radius of curvature is large unless the amount of intrusion of the tip of the separating claw into the fixing roller is made larger. Therefore, in order to ensure the function of the separating claw, namely in order to securely separate the ordinary paper (to prevent paper jamming) regardless of the radius of curvature of the tip of the separating claw, the contact pressure was selected higher for a larger radius of curvature. More specifically, the contact pressure was so selected that the probability of jamming of the ordinary paper does not exceed 5/10000.

TABLE 1

| | Radius R (mm) | | | | | | |
|---|---|---|---|---|---|---|---|
| | 0.02 | 0.03 | 0.04 | 0.05 | 0.06 | 0.07 | 0.1 |
| Contact pres. (N) | 0.0588 | 0.098 | 0.196 | 0.392 | 0.49 | 0.686 | 1.176 |
| Contact line pres. (N/mm) | 0.0294 | 0.049 | 0.098 | 0.196 | 0.245 | 0.343 | 0.586 |
| Roller damage by OHT sheet passing | poor | poor | good | good | good | good | good |
| Roller life in ordinary paper passing ($10^3$) | >40 (O.K) | 40 | 35 | 20 | 13 | 8 | 3 |

With the separating claw of a radius of curvature of 0.02 mm, the roller life in passing the ordinary paper was in excess of 400,000 sheets and sufficiently high, but in passing the OHT sheet of higher rigidity, the tip of the separating claw stabbed into the surface of the fixing roller by the pressure of the OHT sheet, thereby resulting in the peeling not only of the surfacial tube layer of the fixing roller but also the silicone rubber layer thereunder. Similar experiments were repeated several times, but the fixing roller was damaged all the time.

With a radius of curvature of 0.03 mm, the results were similarly to those with a radius of curvature of 0.02 mm.

With a radius of curvature of 0.04 mm, the roller life in passing the ordinary paper was sufficiently as high as 350,000 sheets and the surface of the fixing roller was not damaged.

With a radius of curvature of 0.05 mm, the roller life in passing the ordinary paper and the damage on the fixing roller in passing the OHT sheet were both in practically acceptable level.

With a radius of curvature of 0.06, 0.07 or 0.1 mm, the fixing roller was not damaged in passing the OHT sheet, but the roller life in passing the ordinary paper was as low as respectively 130,000, 80,000 and 30,000 sheets and was not practically acceptable. It is assumed that the tip of the separating claw did not instantly damage the surface of the fixing roller because of the relatively large radius of curvature, but the service life of the fixing roller was reduced because of the large contact pressure thereto.

Then four fixing rollers of different layer structures were prepared and were tested for the damage on the surface of the fixing roller in passing the OHT sheet and for the fixing ability for paper with surface irregularities (rough paper) (Experiment 2). The fixing ability for the rough paper was added for evaluation because the fixing roller is not practically usable unless it is so elastic as to be capable of fixing a toner image onto rough paper. The six separating claws mounted on the fixing unit had a radius of curvature of 0.02 mm at the tips and a contact pressure of 0.0588N to the fixing roller. The obtained results are shown in Table 2.

TABLE 2

| | Soft roller a | Soft roller b | Soft roller c | Hard roller |
|---|---|---|---|---|
| Surface layer (μm) | 30 | 30 | 30 | 30 |
| Rubber layer | 40 | 30 | 50 | none |
| JIS-A hardness (°) | | | | |
| thickness (μm) | 250 | 300 | 300 | none |
| Asker-C hardness (°) | 97 | 97 | 97 | 98 |
| Micro hardness (°) | 82 | 84 | 88 | 90 |
| Roller damage in passing ordinary paper | poor | good | good | good |
| Fixing on rough paper | good | good | no good | poor |

As shown in Tables 1 and 2, the damage on the surface of the fixing roller by the separating claw could be avoided, as already empirically known, by increasing the radius of curvature at the tip of the separating claw by a certain amount or by increasing the hardness of the elastic roller (fixing roller or pressure roller) maintained in contact with the separating claw. Therefore the Asker-C rubber hardness meter (manufactured by Kobunshi Keiki Co., Ltd.), ordinarily employed for measuring the hardness of the elastic roller, was used for measuring the relationship between the hardness of the elastic roller and the radius R of curvature at the tip of the separating claw but no correlation could be found.

Therefore, based on a thought that the damage of the elastic roller caused by the separating claw is related with the micro hardness of the surface of the elastic roller, the micro hardness of the surface of the fixing roller was measured with a micro rubber hardness meter MD-1 (manufactured by Kobunshi Keiki Co., Ltd.).

The surface hardness of the fixing roller was measured in five positions along a circumference at the center in the longitudinal direction of the fixing roller, and the average of the measured values was defined as the surface hardness (hereinafter called micro hardness). In the above-described fixing apparatus 170, the fixing roller 1 (soft roller a) had a micro hardness of 82°.

At first, in order to investigate the correlation between the radius R of curvature of the tip of the separating claw and the micro hardness of the roller thus measured, there was observed the damage on the roller surface under different contact pressures of the tip of the separating claw.

In the following there will be explained the method of experiment.

Figure 4:
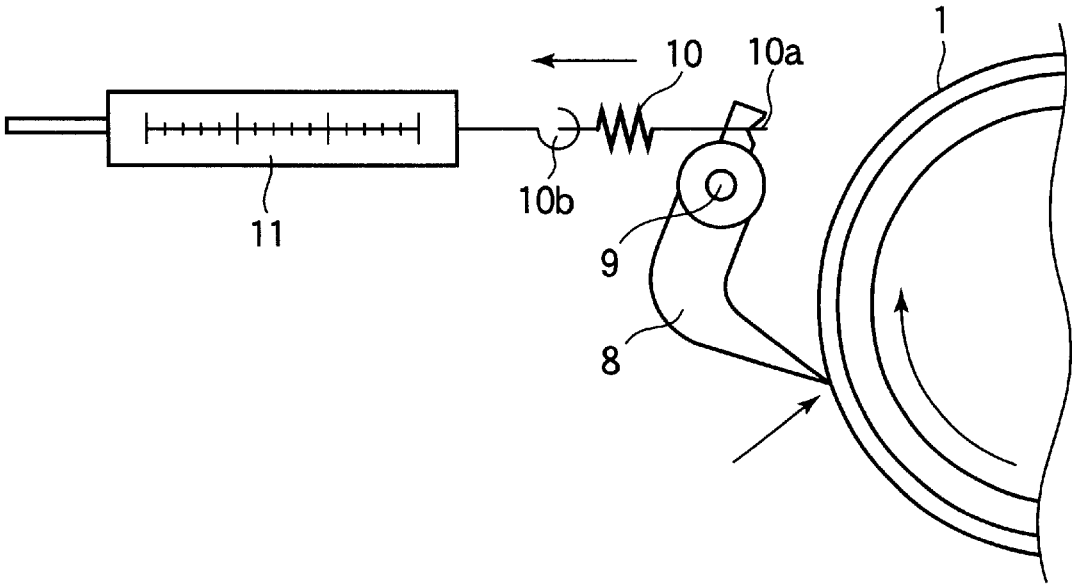
FIG. 4 is a view showing a method for observing the damage caused by the separating claw on the surface of a fixing member.

FIG. 4 is a magnified cross-sectional view of a fixing roller mounted in a fixing apparatus similar to the fixing apparatus 170 and the contact portion of the separating claw.

In the present embodiment, an end 10*a* of a tension spring 10 is connected to the upper end of the separating claw 8 while the other end 10*b* of the tension spring 10 is given a tension by a force gauge 11 thereby applying a predetermined contact pressure to the tip of the separating claw 8. The contact pressure of the separating claw 8 can be arbitrarily changed in the course of rotation of the fixing roller 1 by increasing the tension of the force gauge 11 in a direction in which the end of the tension spring 10 is fixed, while rotating the fixing roller 1 at a constant speed. When the tension of the force gauge 11 reaches a certain value, there can be observed that the surfacial layer of the fixing roller 1 is distorted and eventually broken by the separating claw 8 in contact with the fixing roller 1. The reading of the force gauge 11 at this point is converted into the linear contact pressure Fc (N/mm) of the tip of the separating claw 6. Such linear contact pressure can be easily obtained by a simple geometrical conversion from the reading of the force gauge 11.

Figure 5:
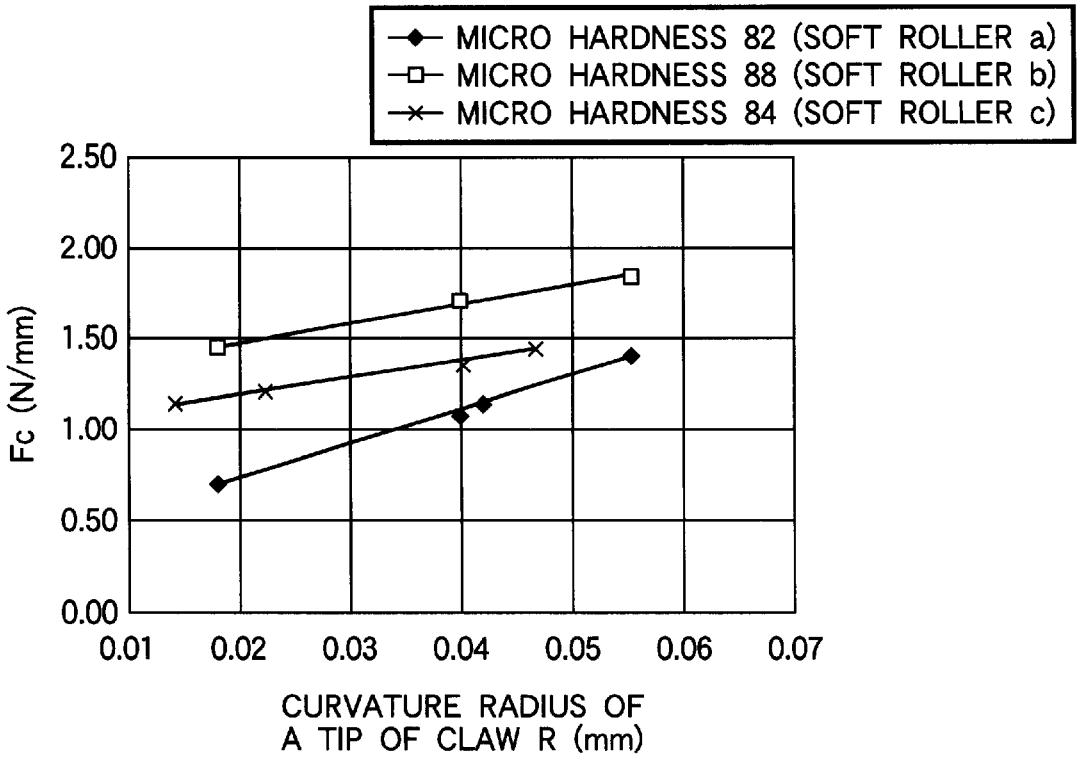
FIG. 5 is a chart showing the relationship between the radius curvature of the tip constituting the contact portion of the separating claw and the contact pressure of the separating claw causing damage to a fixing member or a pressure member by contact with the separating claw.

Such experiment, repeated with different radii R of curvature of the tip of the separating claw 6, lead to a finding that Fc increases linearly to the radius R of curvature at the tip of the separating claw 6, as shown in FIG. 5. This result coincides with the conventional knowledge that a roller is more easily damaged by the separating claw 6 as the radius R of curvature at the tip of the separating claw 6 decreases.

Also based on the result shown in FIG. 5 and that of Experiment 1 in passing the OHT sheet through the fixing nip utilizing the soft roller a (namely a separating claw with radius R=0.04 mm (Fc=1.1 N/mm) did not damage the fixing roller but a separating claw with radius R=0.03 mm (Fc=0.9 N/mm) damaged the fixing roller), the force (linear pressure) received by the roller surface when a resin-coated OHT sheet was pierced by the tip of the separating claw was about 0.98 N/mm at maximum.

Similar observations were made with soft rollers b, c of different layer structures as shown in Table 2.

Figure 6:
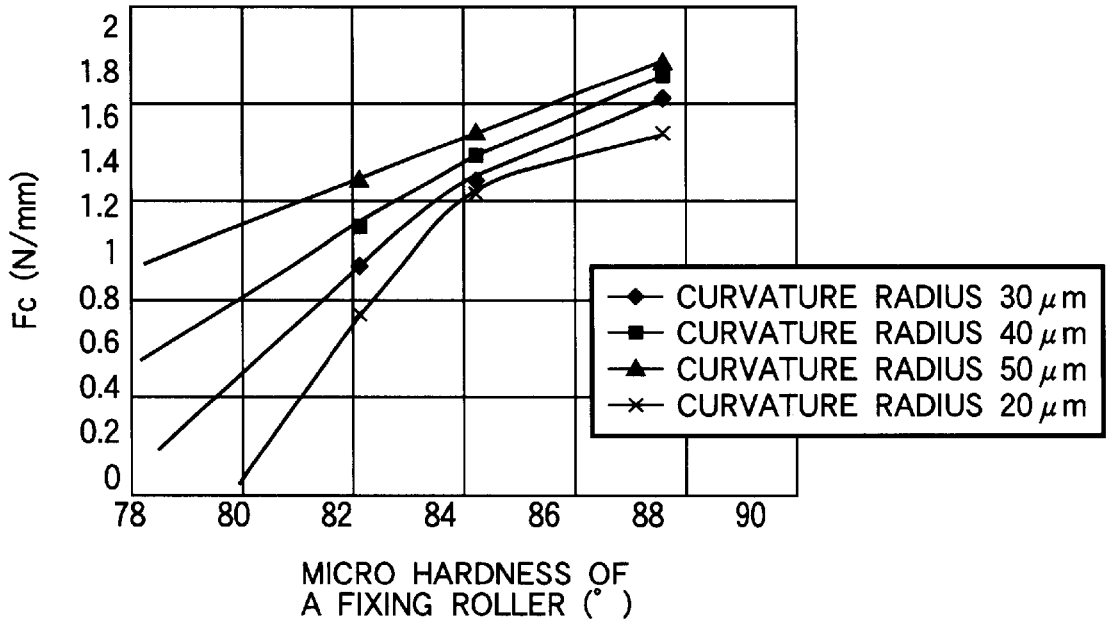
FIG. 6 is a chart showing the relationship between the micro hardness of the surface of the fixing member or the pressure member and the contact pressure of the separating claw causing damage to the fixing member or the pressure member by contact with the separating claw.

As a result, the force Fc, at which the roller starts to be damaged, becomes larger as the micro hardness of the roller increases. Based on the result shown in FIG. 5, FIG. 6 shows the relationship between the micro hardness of the roller in the abscissa and Fc in the ordinate.

It is already known that the force (linear pressure) received by the roller surface when the resin-coated OHT sheet was pierced by the tip of the separating claw was about 0.98 N/mm. Therefore, in order that the separating claw with a radius R does not damage the roller, there can be known, from FIG. 6, that the roller is required to have a micro hardness at least equal to the crossing point of a line Fc=0.98 N/mm and a line for the corresponding radius R.

Figure 7:
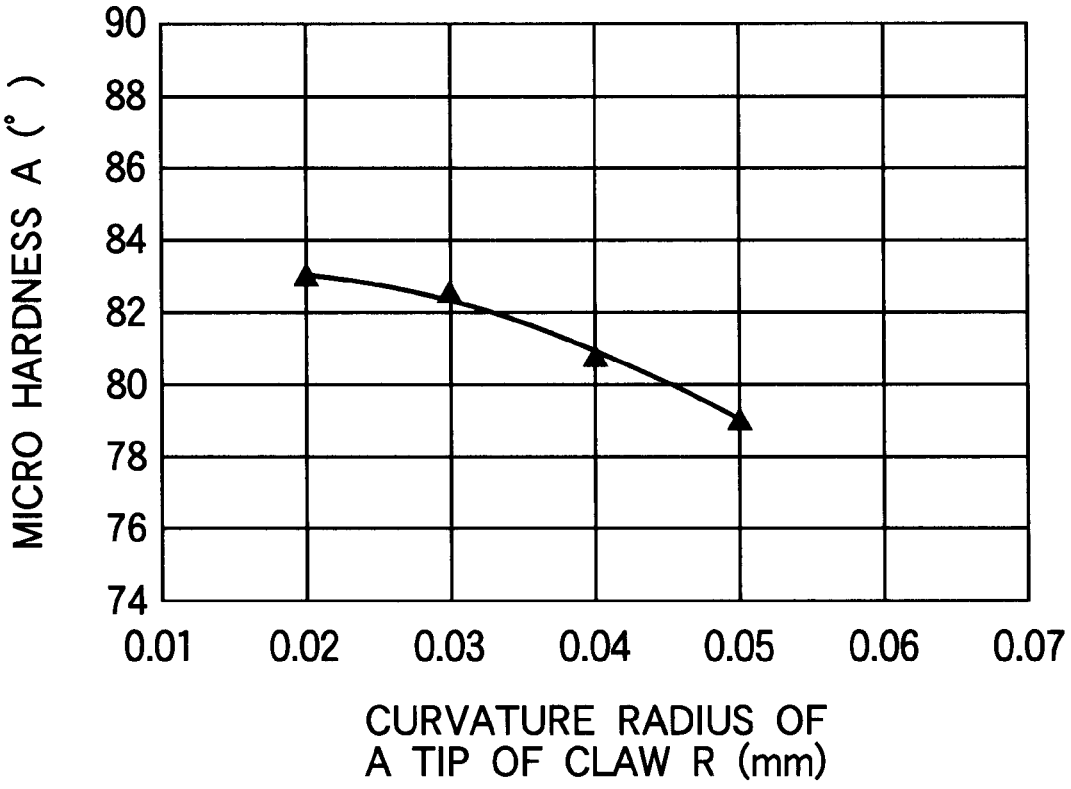
FIG. 7 is a chart showing the relationship between the radius of curvature of the tip constituting the contact portion of the separating claw and the micro hardness of the surface of the fixing member or the pressure member contacted by the separating claw.

FIG. 7 shows the relationship between the radius R of the separating claw in the abscissa and the micro hardness A of the roller in the ordinate for constant Fc=0.98 N/mm. FIG. 7 indicates, in order not to damage the roller surface under a constant force applied to the tip of the separating claw, that the radius R of curvature at the tip of the separating claw and the micro hardness A of the roller are required to satisfy following relationship:

$$A \geqq -3250.0R^2+90.5R+82.5 \quad (1)$$

As will be apparent from a fact that the force applied to the tip of the separating claw is represented by linear pressure, this relation is independent from the dimension (contact width) or shape of the separating claw.

The condition (1) clarifies the relationship between the radius R of curvature at the tip of the separating claw and the micro hardness A of the roller required for not damaging the roller surface.

As will be apparent from FIG. 7, a larger value of the radius R increases the range of the micro hardness of the roller capable of avoiding the damage on the roller surface. However, with a larger radius R, there is required a larger amount of intrusion of the tip of the separating claw into the roller in order to secure the separating ability for the ordinary paper, and there is required a higher contact pressure (linear pressure) of the separating claw. As a result, the life of the roller in passing the ordinary paper is extremely shortened as shown in Table 1. For this reason, the radius R of the curvature at the tip of the separating claw is preferably 0.05 mm or smaller. The roller life in passing the ordinary paper means the number of sheets passed until the occurrence of a phenomenon that the PFA tube layer at the roller surface is abraded by the contact of the separating claw to expose the silicone rubber layer thereunder and the toner is deposited on the exposed silicone rubber layer and is transferred onto the recording material to cause toner stain thereon.

In case the radius R of the separating claw is small, the micro hardness of the roller can be selected higher according to the relation (1), but a micro hardness of the roller equal to or higher than 88° deteriorates the fixing ability on the rough paper as shown in Table 2. The so-called hard roller consisting solely of fluorinated resin on the metal core, without the elastic layer, had a micro hardness of 90°, and, with the micro hardness equal to or higher than 88°, there is lost the effect of the elastic roller capable of following the surface irregularities of the paper.

Therefore, in consideration of the possible fluctuation ±2.5° in the micro hardness of the roller and also in consideration of the fixing ability on the rough paper, the radius R of curvature at the tip of the separating claw is preferably 0.02 mm or larger, based on FIG. 7 and Table 2.

As explained in the foregoing, regardless of the structure and shape of the fixing roller, there can be found a conventionally unknown condition for avoiding the damage on the roller surface by the separating claw, by measuring the micro hardness of the roller surface and the radius of curvature at the tip of the separating claw. Particularly in the case of a fixing apparatus without an oil coating member as in the present embodiment, it is rendered possible to avoid the damage on the roller surface without sacrificing the roller life in passing the ordinary paper, by contacting a separating claw with a tip more pointed than in the conventional art with the roller surface under a low pressure.

In the present embodiment, there has been explained an elastic roller (fixing roller or pressure roller) having a PFA tube layer as the releasing layer on the silicone rubber layer, but there may also be employed a roller having a sintered PTEE layer as another releasing layer, or an elastic roller composed solely of a fluorinated rubber layer on the metal core.

Furthermore, the present embodiment may also be applied to a pressure roller having a fluorinated resin layer on a silicone rubber layer as in the fixing roller.

Second Embodiment

In the following there will be explained a second embodiment of the present invention, wherein components the same as those in the first embodiment are represented by the same numbers and will not be explained further.

The present embodiment is featured in that the aforementioned relation (1) is satisfied between the radius R of curvature of a curved surface of at least a portion, intruding the surface of the elastic fixing roller 1, of the tip of the separating claw and the micros hardness A (°) of the fixing roller 1 and that the shape of the tip of the separating claw is so shaped that the radius r1 of curvature of a curved surface in a position where the recording material impinges on the surface of the tip of the separating claw is smaller than R.

Figure 8:
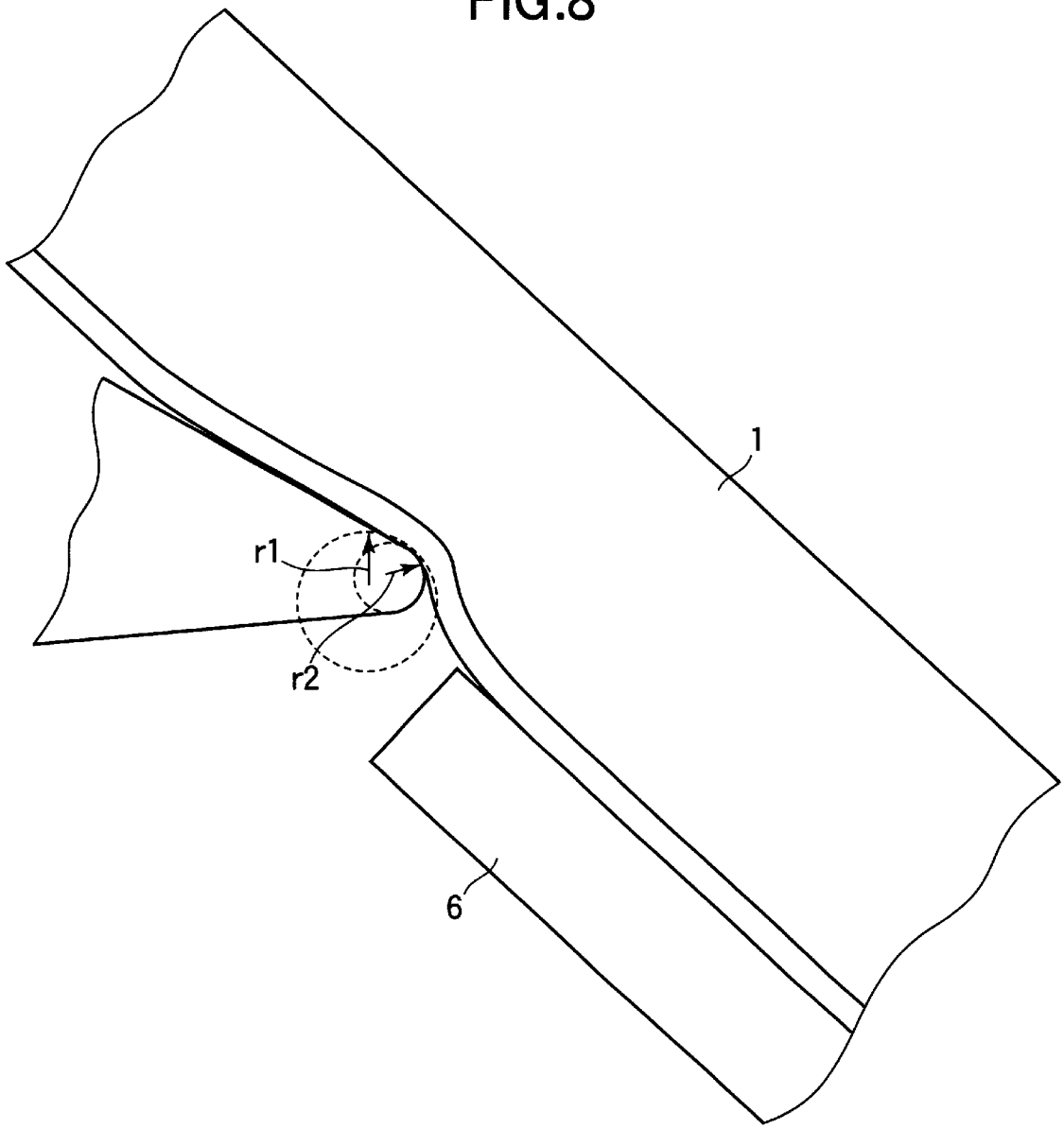
FIG. 8 is a view showing a contact state of a separating claw constituting a second embodiment of the present invention with a fixing member.

FIG. 8 is a cross-sectional view showing a state where the separating claw of the present embodiment is in contact with the surface of the fixing roller 1.

A shown in FIG. 8, the radius R of curvature of the curved surface of the separating claw in contact with the surface of the fixing roller 1 is so formed as to satisfy the relation (1) with the micro hardness A of the roller, as already explained in the first embodiment. On the other hand, the radius r1 of curvature of a curved surface of the sheet passing side (nip side), which does not come into contact with the surface of the fixing roller 1 and is in the impingement position of the tip of the separating claw, is made smaller than R in order to facilitate the separation of the recording material.

Specifically, the above-described separating claw can be prepared, for example, by forming a base material in such a manner that the tip of the separating claw has a uniform radius R of curvature, then so polishing the paper passing side as to obtain a radius r1 and covering the surface with PFA resin with spray coating.

In the present embodiment, the fixing roller 1 has a micro hardness of 84°, while the tip of the separating claw has a radius R of curvature of 0.04 mm at a side contacting the roller and a radius r1 of curvature of 0.02 mm on a curved surface at the paper passing side, and such separating claw is contacted by a tension spring under a pressure of 0.0784 N (linear pressure 0.0392 N/mm).

As a result, the roller surface was not damaged even in case of passing the resin-coated OHT sheet, and the life of the fixing roller was extended to 500,000 sheets. This is because the abrasion of the roller surface by the separating claw was reduced since the contact pressure by the tension spring was reduced from 0.98N to 0.0784N in comparison with the aforementioned first embodiment.

Third Embodiment

In the following there will be explained a third embodiment of the present invention, wherein components the same as those in the first embodiment are represented by the same numbers and will not be explained further.

Figure 9:
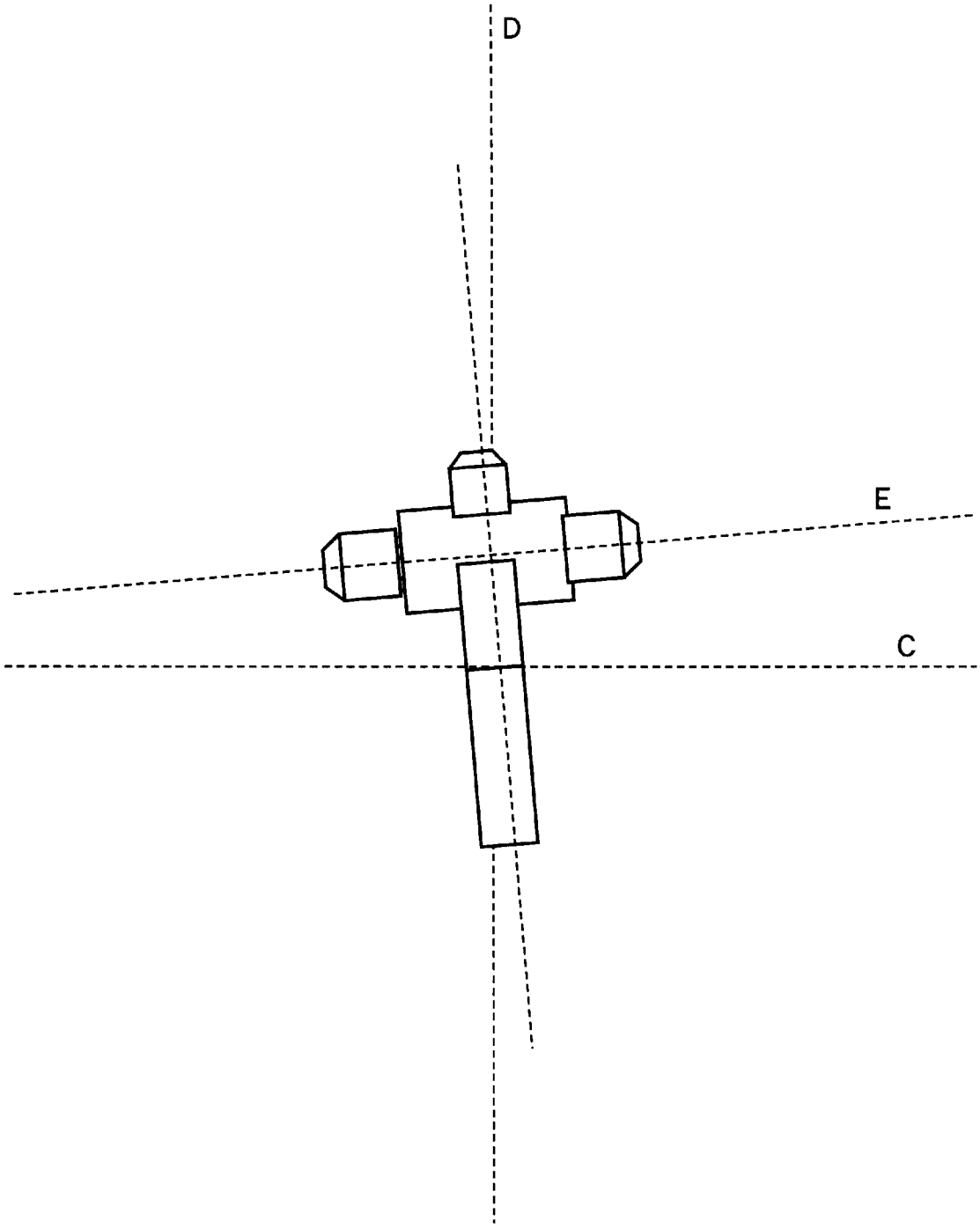
FIG. 9 is a view showing a state of uneven contact of the separating claw with the surface of the fixing member or the pressure member.
Figure 10:
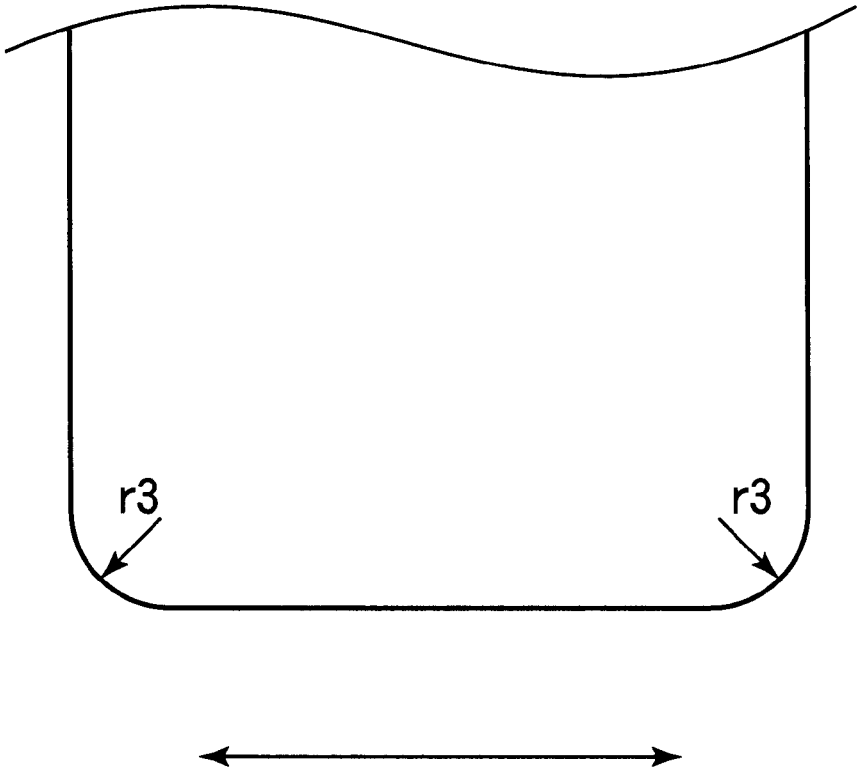
FIG. 10 is a magnified view, in the longitudinal direction, of a tip constituting the contact portion of a separating claw in a third embodiment of the present invention.

In FIG. 9, a line C is parallel to the rotary center of the fixing roller, and a line D is perpendicular to the line C. The separating claw is usually so positioned that a line E passing through the center of the rotary axis becomes parallel to the line C, in order to avoid uneven contact of the contact portion at the tip of the separating claw. However, in case of defective separation of the recording material by the separating claw, the tip of the separating claw pressed by the recording material becomes inclined by the play in the rotary axis as shown in FIG. 9 to result in so-called uneven contact wherein the tip of the separating claw comes into contact at a corner portion thereof with the roller surface, thereby damaging the roller surface.

In particular, in the fixing apparatus equipped with the reciprocating mechanism for reciprocating the separating claw in the longitudinal direction of the fixing roller in order to relax the abrasion of the roller caused by the contact of the separating claw, such uneven contact is easily generated, resulting in the damage on the roller surface.

The present embodiment is featured in that the tip of the separating claw is provided, at both ends across the contact width (indicated by an arrow in the drawing), with arc portions with a radius r3 of curvature and that radius r3 of curvature of such arc potions satisfies the aforementioned relation (1) with the micro hardness A of the fixing roller 1.

In the present embodiment, polyetherketone PEK was employed as the base material since the small arc portions as explained above are difficult to obtain by pressing heat-resistant resin such as polyimide PI. The above-mentioned base material was coated with conductive PFA resin by spray coating to obtain a separating claw with a radius R of curvature of 0.04 mm in the contact portion of the tip of the separating claw and radius r3 of curvature of 0.035 mm in the arc portions.

The above-described separating claw was maintained in contact with a fixing roller having a micro hardness of 84° at the roller surface and was subjected to a sheet passing test utilizing the resin-coated OHT sheet and a sheet passing test utilizing the reciprocating mechanism, but no damage was found on the surface of the fixing roller.

The present embodiment is particularly effective for a fixing apparatus provided with the aforementioned reciprocating mechanism which tends to cause the uneven contact of the tip of the separating claw, and a fixing apparatus which is so constructed that the separating claw moves to the downstream side in the rotating direction of the fixing roller in case of a defective separation, thereby reducing the pressure of the tip of the separating claw resulting from the jammed sheet and which requires a relatively large play in the support of the separating claw.

Furthermore, in the present embodiment, it is not necessary to increase the dimension of the tip portion of the separating claw since the width of the tip thereof can be maintained at a necessary minimum value for avoiding damage on the roller. As a result, it is rendered possible to minimize the amount of the toner sticking to the separating claw and to prevent floating thereof from the roller surface.

The present invention is not limited to the foregoing embodiments but is subject to various modifications within the scope and spirit of the appended claims.

What is claimed is:

1. An image fixing apparatus for heating an image formed on a recording material, comprising:

a rotating member for rotating in contact with the recording material, said rotating member having an elastic layer and a surface resin layer; and a separating claw for separating the recording material from said rotating member, wherein a contact pressure of the separating claw to the rotating member is equal to or greater than 0.058 N and equal to or less than 0.392 N, and wherein a micro hardness A of a surface of said rotating member and a radius R of curvature at the tip of said separating claw satisfy a relation:

$$A \geqq -3250.0R^2+90.5R+82.5 \text{ and } 0.02 \leqq R \leqq 0.05.$$

* * * * *

UNITED STATES PATENT AND TRADEMARK OFFICE

CERTIFICATE OF CORRECTION

PATENT NO. : 6,587,662 B2
DATED : July 1, 2003
INVENTOR(S) : Yasunari Kobaru et al.

It is certified that error appears in the above-identified patent and that said Letters Patent is hereby corrected as shown below:

Column 1,
Line 61, “form” should read -- from --.

Column 2,
Line 17, “such” should read -- such a --.

Column 6,
Line 62, “similarly” should read -- similar --.

Column 10,
Line 7, “micros” should read -- micro --.
Line 29, “then so” should read -- then --.

Signed and Sealed this

Ninth Day of December, 2003

JAMES E. ROGAN
*Director of the United States Patent and Trademark Office*